US009067437B2

(12) United States Patent
Masuda

(10) Patent No.: US 9,067,437 B2
(45) Date of Patent: Jun. 30, 2015

(54) LIQUID DISCHARGE APPARATUS

(71) Applicant: SEIKO EPSON CORPORATION, Tokyo (JP)

(72) Inventor: Norihiro Masuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/185,244

(22) Filed: Feb. 20, 2014

(65) Prior Publication Data

US 2014/0240418 A1 Aug. 28, 2014

(30) Foreign Application Priority Data

Feb. 26, 2013 (JP) ..... 2013-035513

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 2/01; B41J 2/16508; B41J 2/1714; B41J 2/185; B41J 2/20; B41J 11/0015; B41J 11/002; B41J 2002/1742; B41M 7/0072; C09D 11/101
USPC ..... 347/34, 102
See application file for complete search history.

(56) References Cited

U.S. PATENT DOCUMENTS

| | | | | |
|---|---|---|---|---|
| 2004/0061738 | A1* | 4/2004 | Unosawa | 347/34 |
| 2004/0114017 | A1 | 6/2004 | Yokoyama | |
| 2010/0224693 | A1* | 9/2010 | Koike et al. | 239/1 |
| 2012/0206528 | A1* | 8/2012 | Nakajima | 347/16 |

FOREIGN PATENT DOCUMENTS

| | | |
|---|---|---|
| JP | 2004-203025 | 7/2004 |
| JP | 2010-208092 | 9/2010 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid discharge apparatus includes a first head, a second head on a downstream side in the transport direction from the first head, a first irradiation section between the first head and the second head, a second irradiation section arranged on the downstream side in the transport direction, a first mist recovery section that is arranged between the first head and the first irradiation section, a second mist recovery section that is arranged between the second head and the second irradiation section, and an air flow adjustment member that is arranged between the second mist recovery section and the second irradiation section, adjusts an amount of air which is absorbed into the second mist recovery section, and decreases the air which is absorbed from the downstream side in the transport direction than the second mist recovery section in the air which is absorbed into the second mist recovery section.

6 Claims, 7 Drawing Sheets

LIQUID DISCHARGE APPARATUS

BACKGROUND

1. Technical Field

The present invention relates to a liquid discharge apparatus.

2. Related Art

As a liquid discharge apparatus, an ink jet printer that forms an image by discharging a liquid (for example, UV ink) which is cured by receiving irradiation of light (for example, ultraviolet ray (UV)) from a head is known. As such a printer, a line type printer that is provided with a mist recovery section in the vicinity of the head in order to absorb a mist which is generated around the head is known (for example, see JP-A-2010-208092). In the printer of JP-A-2010-208092, the mist recovery section is provided between each head and an irradiation section of UV, respectively.

Furthermore, it is also known that the irradiation of UV is performed in two stages (precuring, main curing) (for example, see JP-A-2004-203025). In the printer of JP-A-2004-203025, a precuring irradiation section (first irradiation section) is provided in each head (on a downstream side in a transport direction of each head), and a main curing irradiation section (second irradiation section) is provided on the most downstream side in the transport direction. However, the precuring irradiation section is not provided with respect to the head on the most downstream side in the transport direction, and the ink which is discharged from the head is fully cured with only the irradiation by the main curing irradiation section.

When the technology of JP-A-2010-208092 is combined with the technology of JP-A-2004-203025, in the mist recovery section which responds to the head on the most downstream side in the transport direction, the precuring irradiation section which responds to the head is not arranged. Therefore, air that is absorbed into the mist recovery section from the downstream side in the transport direction increases, and the air that is absorbed into the mist recovery section from a head side (an upstream side in the transport direction) decreases. As described above, there is a concern that absorption efficiency of the mist falls since air flow of the mist absorption is disturbed.

SUMMARY

An advantage of some aspects of the invention is to improve the absorption efficiency of the mist.

According to an aspect of the invention, there is provided a liquid discharge apparatus including a transport body that transports a recording medium in a transport direction, a first head that discharges a droplet of a photocurable liquid which is cured by receiving irradiation of light onto the recording medium which is supported by the transport body, a second head that is arranged on a downstream side in the transport direction than the first head and discharges the droplet of the photocurable liquid onto the recording medium which is supported by the transport body, a first irradiation section that is arranged between the first head and the second head and irradiates the photocurable liquid which lands on the recording medium with the light, a second irradiation section that is larger than the first irradiation section in terms of an integrating light amount per unit area of the recording medium and is arranged on the downstream side in the transport direction than the second head so that a distance between the second head and the second irradiation section is greater than that between the first head and the first irradiation section, a first mist recovery section that is arranged between the first head and the first irradiation section and recovers a mist of the photocurable liquid which is discharged from the first head, a second mist recovery section that is arranged between the second head and the second irradiation section and recovers the mist of the photocurable liquid which is discharged from the second head, and an air flow adjustment member that is arranged between the second mist recovery section and the second irradiation section, adjusts an amount of air which is absorbed into the second mist recovery section, and makes the air which is absorbed from the downstream side in the transport direction than the second mist recovery section in the air which is absorbed into the second mist recovery section smaller than that in a case that the air flow adjustment member is not arranged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview

Figure 1:
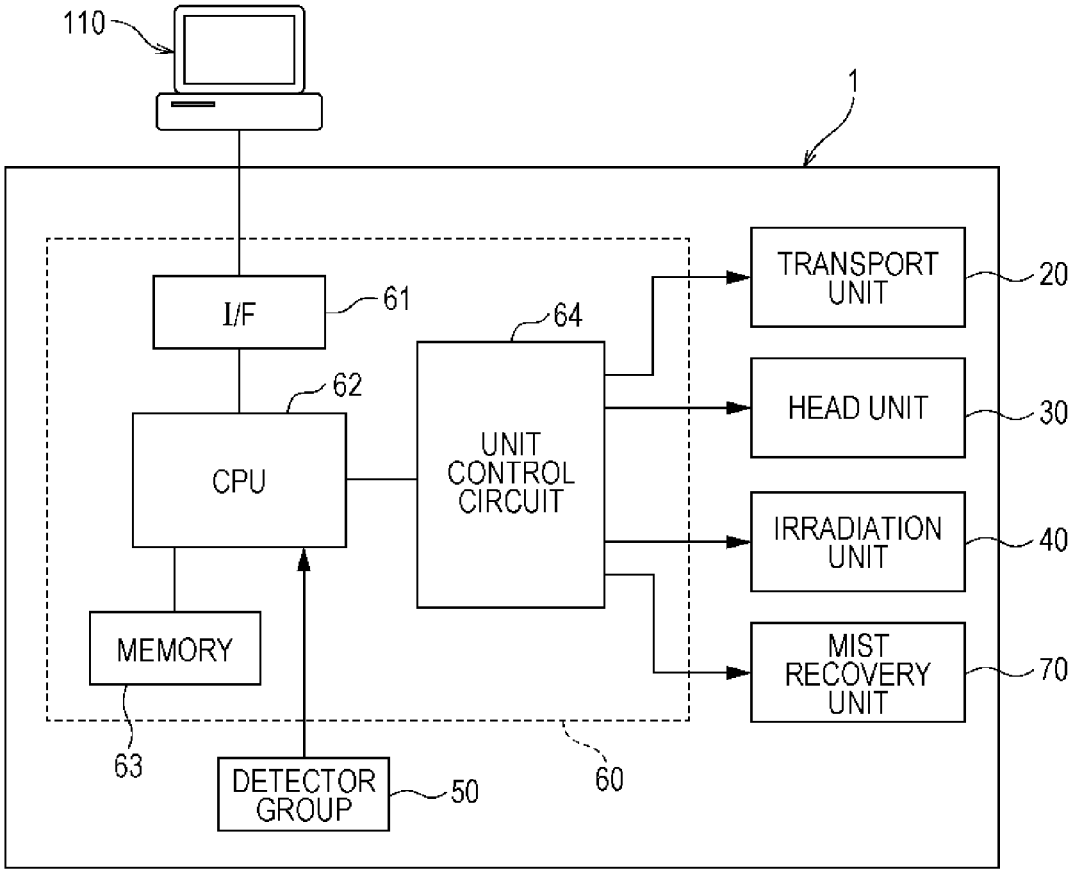
FIG. 1 is a block diagram of an overall configuration of a printer.

At least, the following matters are clarified by the description of the specification and the drawings.

According to an aspect of the invention, there is provided a liquid discharge apparatus including a transport body that transports a recording medium in a transport direction, a first head that discharges a droplet of a photocurable liquid which is cured by receiving irradiation of light onto the recording medium which is supported by the transport body, a second head that is arranged on a downstream side in the transport direction than the first head and discharges the droplet of the photocurable liquid onto the recording medium which is supported by the transport body, a first irradiation section that is arranged between the first head and the second head and irradiates the photocurable liquid which lands on the recording medium with the light, a second irradiation section that is larger than the first irradiation section in terms of an integrating light amount per unit area of the recording medium and is arranged on the downstream side in the transport direction than the second head so that a distance between the second head and the second irradiation section is greater than that between the first head and the first irradiation section, a first mist recovery section that is arranged between the first head and the first irradiation section and recovers a mist of the photocurable liquid which is discharged from the first head, a second mist recovery section that is arranged between the second head and the second irradiation section and recovers the mist of the photocurable liquid which is discharged from the second head, and an air flow adjustment member that is arranged between the second mist recovery section and the second irradiation section, adjusts an amount of air which is absorbed into the second mist recovery section, and makes the air which is absorbed from the downstream side in the transport direction than the second mist recovery section in the air which is absorbed into the second mist recovery section smaller than that in a case that the air flow adjustment member is not arranged.

According to the liquid discharge apparatus, it is possible to increase the air which is absorbed into the second mist recovery section from a second head side (an upstream side in the transport direction). Therefore, it is possible to improve the absorption efficiency of the mist.

In the liquid discharge apparatus, it is preferable that a distance between the second head and the air flow adjustment member in the transport direction is the same as the distance between the first head and the first irradiation section in the transport direction, and the air flow adjustment member has the same shape as the first irradiation section.

According to the liquid discharge apparatus, it is possible to make the absorption efficiency of the mist of the second mist recovery section similar to the absorption efficiency of the mist of the first mist recovery section.

In the liquid discharge apparatus, it is preferable that the first mist recovery section and the second mist recovery section have the same shapes, the first irradiation section is attached to a portion of the first mist recovery section on the downstream side in the transport direction than an absorption port which is included in the first mist recovery section, and the air flow adjustment member is attached to a portion of the second mist recovery section on the downstream side in the transport direction than an absorption port which is included in the second mist recovery section, and the attached position is the same as the position where the first irradiation section is attached to the first mist recovery section.

According to the liquid discharge apparatus, it is possible to further improve the absorption efficiency of the mist of the second mist recovery section, and it is possible to make difficult to hit the second head with the light which is leaked from the second irradiation section.

In the liquid discharge apparatus, the transport body may be a cylindrical transport drum which transports the recording medium in a peripheral surface.

In the liquid discharge apparatus, it is preferable that the second head and the second mist recovery section are provided to be inclined with respect to a vertical direction so as to face the peripheral surface of the transport drum, and the air flow adjustment member includes a liquid absorbent material to absorb the photocurable liquid.

According to the liquid discharge apparatus, it is possible to prevent the photocurable liquid from falling from the second head and the second mist recovery section.

In the liquid discharge apparatus, it is preferable that a surface color of the air flow adjustment member is black.

According to the liquid discharge apparatus, it is possible to prevent the light which is leaked from the second irradiation section from being reflected, and it is possible to suppress influence by the leaked light (nozzle clogging of the second head or the like).

In the following embodiments, as a liquid discharge apparatus, an ink jet printer (hereinafter, referred to as printer 1) will be described as an example.

Embodiment

Regarding Configuration of Printer

Figure 2:
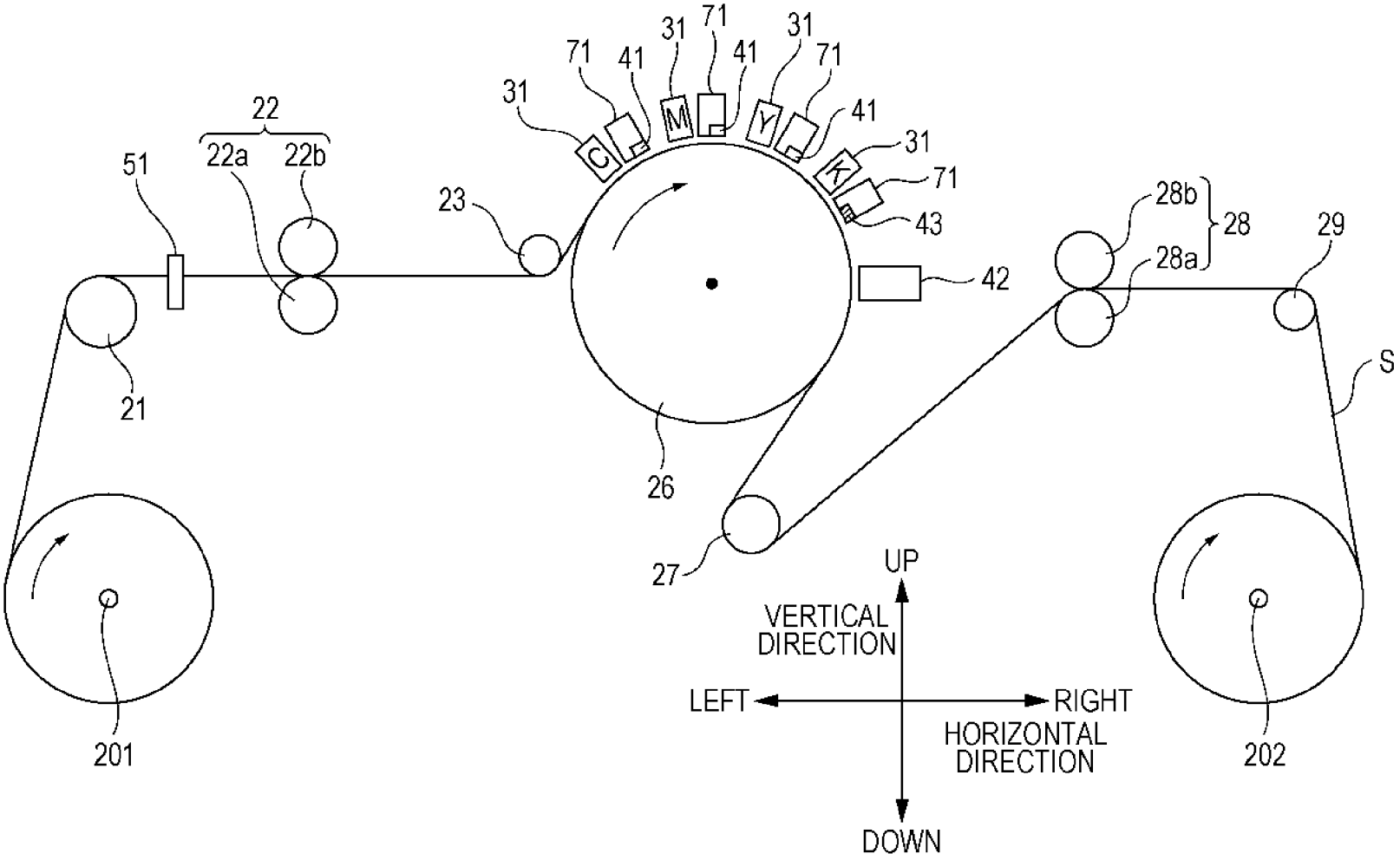
FIG. 2 is a schematic diagram of a transport path including a print area.

FIG. 1 is a block diagram of an overall configuration of a printer 1. FIG. 2 is a schematic diagram of a transport path including a print area.

The printer 1 is a printing apparatus for printing an image on a recording medium such as paper, cloth, and film (hereinafter, simply referred to as medium), and is connected to a computer 110 which is an external device so as to communicate with each other. In the embodiments, the paper which is wound into a roll (continuous paper) will be described as an example of the medium on which the printer 1 records the image.

A printer driver is installed in the computer 110. The printer driver is a program for displaying the user interface in a display device (not shown) and converting the image data which is output from the application program into print data. The printer driver is recorded in the recording medium such as a flexible disk FD and a CD-ROM (computer-readable recording medium). Alternatively, it is possible to download the printer driver in the computer 110 via the Internet. The program is configured of codes for achieving various functions.

Therefore, in order to print the image in the printer 1, the computer 110 outputs the print data in accordance with the image to be printed to the printer 1.

The printer 1 according to the embodiment is the device that prints the image on the medium by discharging an ultraviolet curable ink (hereinafter, referred to as UV ink) which is cured by receiving the irradiation of the ultraviolet ray (Ultra Violet Light: hereinafter, abbreviated to "UV") which is a kind of light, as an example of the liquid. The UV ink is the ink including an ultraviolet curable resin, and is cured by receiving the irradiation of the UV and causing photopolymerization reaction in the ultraviolet curable resin. The printer 1 according to the embodiment prints the image using the UV inks of four colors of cyan (C), magenta (M), yellow (Y) and black (K) (color ink).

The printer 1 includes a transport unit 20, a head unit 30, an irradiation unit 40, a detector group 50, and a controller 60. The printer 1 that receives the print data from the computer 110 which is the external device, controls each section (the transport unit 20, the head unit 30 and the irradiation unit 40) by the controller 60, and prints the image on the medium in accordance with the print data. Based on the print data which is received from the computer 110, the controller 60 controls each unit, and prints the image on the medium (roll paper S). A state of the printer 1 is monitored by the detector group 50, and the detector group 50 outputs the detection result to the controller 60. Based on the detection result which is output from the detector group 50, the controller 60 controls each unit.

The transport unit 20 transports the roll paper S along the transport path which is set in advance. As shown in FIG. 2, the transport unit 20 includes a feeding shaft 201 around which the roll paper S is wound and is rotatably supported, a relay roller 21, a first transport roller 22, a relay roller 23, a transport drum 26, a tension roller 27, a second transport roller 28, a tension roller 29, and a winding drive shaft 202 that winds the roll paper S which passes through the tension roller 29.

The transport drum 26 (corresponding to the transport body) is a cylindrical transport member, and transports the roll paper S in the transport direction while supporting the roll paper S in the peripheral surface. The transport drum 26 faces each head and each UV irradiation section which are described later, through the roll paper S. Furthermore, the roll paper S is transported so as to adhere to the transport drum 26 at a predetermined tension.

By moving the roll paper S via each roller sequentially, the transport path for transporting the roll paper S is formed.

The head unit 30 discharges the UV ink to the roll paper S. By discharging the ink from each head with respect to the roll paper S during the transport, the head unit 30 prints the image by forming dots on the roll paper S. Each head of the head unit 30 of the printer 1 according to the embodiment can form the dots at once as a paper width of the medium (roll paper S). Moreover, in the embodiment described above, as an UV ink, the color inks of the four colors for forming the image are used. As shown in FIG. 2, heads 31 that discharge each UV inks of cyan (C), magenta (M), yellow (Y) and black (K) in sequence from the upstream side in the transport direction, are provided so as to face the peripheral surface of the transport drum 26. The details of the configuration of the head unit 30 will be described later.

The irradiation unit 40 irradiates the UV ink which lands on the medium with the UV. By receiving the irradiation of the UV from the irradiation unit 40, the dots which are formed on the medium is cured. The irradiation unit 40 according to the embodiment includes a precuring irradiation section 41 (corresponding to the first irradiation section) and a main curing irradiation section (corresponding to the second irradiation section). Furthermore, the irradiation unit 40 according to the embodiment includes a dummy irradiation section 43 which does not perform the irradiation of the UV (corresponding to the air flow adjustment member). The details of each irradiation section will be described later.

The detector group 50 includes an end detection sensor 51, a rotary encoder (not shown), a paper detection sensor (not shown) or the like. The end detection sensor 51 detects the end of the roll paper S in the width direction and detects meandering of the roll paper S. The rotary encoder detects rotation amounts of a first drive roller 22*a* and a second drive roller 28*a*. It is possible to detect the transport amount of the medium, based on the detection result of the rotary encoder.

The controller 60 is the control unit for performing the control of the printer 1 (control section). The controller 60 includes an interface section 61, a CPU 62, a memory 63, and a section control circuit 64. The interface section 61 sends and receives the data between the computer 110 which is the external device and the printer 1. The CPU 62 is an execution processing section for performing the control of the overall printer. The memory 63 includes a storage element such as a RAM and a EEPROM in order to secure an area which stores the program of the CPU 62 and a work area. Moreover, the memory 63 includes a register for holding control information such as flags described later. According to the program which is stored in the memory 63, the CPU 62 controls each section via the section control circuit 64.

The mist recovery unit 70 recovers the mist of the droplet of the ink which is discharged from each head 31. The mist (specifically, the droplet of which diameter size approximately is 0.5μ to 10μ) is the micro droplet of the liquid that is minute than the droplet of the ink, and is generated when the droplet of the ink is discharged from nozzles of the heads 31. The printer 1 according to the embodiment includes a mist recovery section 71 that recovers the mist with respect to the heads 31 of each color (specifically, on the downstream side in the transport direction with respect to the heads 31 of each color). The details of the mist recovery section 71 will be described later.

Regarding Configuration of Head

The printer 1 according to the embodiment is provided with the four heads 31 with respect to each ink color (C, M, Y, K), as described above. Each of the heads 31 discharges the UV ink (color ink) for printing the image with respect to each ink color.

In the embodiment, all heads 31 of each color have the same configuration, and, in each head 31, the nozzles for discharging the UV ink are arranged side by side at a predetermined interval in the nozzle row direction. Specifically, in the printer 1 according to the embodiment, the nozzles of the heads 31 are in a line at the interval (nozzle pitch) of 600 dpi (1/600 inch), along the nozzle row direction. The nozzle row direction is the direction (paper width direction of the roll paper S) which is perpendicular to the transport direction of the roll paper S. Furthermore, length of the heads 31 in the nozzle row direction (paper width direction) is greater than the paper width of the roll paper S. Therefore, it is possible to form the dots at the resolution of 600 dpi in the paper width direction. Moreover, the resolution in the transport direction can be adjusted by the discharge timing of the ink from the nozzles and the transport speed. In the embodiment, the dots are formed at the resolution of 600 dpi even in the transport direction (the print resolution is 600 dpi×600 dpi).

In the nozzles of the heads 31, piezoelectric elements are arranged in response to each nozzle. Therefore, on the basis of a drive signal which is applied to the piezoelectric elements by the controller 60, the ink is discharged from the nozzle in response to the piezoelectric element.

Regarding Print Processing

When the printer 1 starts the print, the roll paper S is arranged in the transport path along the peripheral surface of the transport drum 26 in advance. Therefore, the tension is given to the roll paper S by the output torque of the feeding shaft 201, the winding drive shaft 202, and the second transport roller 28. Specifically, the predetermined tension is given to the feeding portion of the roll paper S by the brake torque of the feeding shaft 201, depending on the roll diameter of the roll paper S. In the print area portion, the tension is detected with the tension roller 27, and the torque of a motor (not shown) of the second transport roller 28 is controlled so as to be the predetermined tension. In the winding portion, the tension is detected with the tension roller 29, and the torque of a motor (not shown) of the winding drive shaft 202 is controlled so as to be the predetermined tension. Each tension is determined in advance, depending on the roll diameter of the roll paper S.

The printer 1 receives the print data from the computer 110, and the controller 60 rotates a motor (not shown) of the first transport roller 22 at the constant speed. As described above, in the state where the tension is given to the roll paper S, the first transport roller 22 is rotated at the constant speed, thereby transporting the roll paper S at the constant speed in the transport direction. By the frictional force between the roll paper S and the transport drum 26, the transport drum 26 rotates in the arrow direction (transport direction) following the transport of the roll paper S.

The roll paper S on the peripheral surface of the transport drum 26 is transported in the transport direction, depending on the rotation of the transport drum 26. Moreover, the roll paper S during the transport adheres to the transport drum 26. In the embodiment, since the position of each head 31 is fixed, each head 31 and the roll paper S relatively move in the transport direction, when the roll paper S is transported in the transport direction.

While the roll paper S is transported on the peripheral surface of the transport drum 26, the controller 60 makes the droplet of the ink be discharged intermittently from the nozzles of each head 31 of the head unit 30 (dot forming operation), on the basis of the image data that is received from the computer 110. Accordingly, the dots are formed on the roll paper S. The controller 60 makes the UV be irradiated with from each irradiation section of the irradiation unit 40, and the mist be recovered by the mist recovery unit 70.

In particular, first, when the roll paper S passes below the head 31 of cyan, the controller 60 makes cyan be printed (forms the dot of cyan) by discharging the cyan ink from the head 31 of cyan. Thereafter, the controller 60 makes the mist which is generated when the head 31 of cyan discharges the cyan ink, be recovered by the mist recovery section 71 on the downstream side in the transport direction with respect to the head 31 of cyan, the UV be irradiated with from the precuring irradiation section 41 which is arranged in the mist recovery section 71, and the cyan ink which lands on the roll paper S be cured.

The above operations are performed with respect to the ink of other color in the same manner. However, since the precuring irradiation section 41 is not provided with respect to black on the most downstream side in the transport direction, the precuring with the irradiation of the UV is not performed (the reason will be described later).

Finally, the controller 60 makes the UV be irradiated with from the main curing irradiation section 42, and each dot on the roll paper S be fully cured.

Regarding Irradiation Section

In the printer 1 according to the embodiment, the precuring irradiation section 41 and the main curing irradiation section 42 are included as the irradiation unit 40, thereby performing the curing in two stages of the precuring and the main curing after forming the dots. Hereinafter, the function of each curing will be described.

The precuring is the curing for suppressing the bleeding between the inks and the spread of the dots by curing the surface of the dots. The integrating light amount per unit area of the medium is small in the irradiation of the UV of the precuring. For this reason, the UV inks (dots) are not fully cured even after the precuring.

The main curing is the curing for solidifying the ink fully. The integrating light amount per unit area of the medium in the irradiation of the UV of the main curing is greater than that in the irradiation of the UV of the precuring.

In the printer 1 according to the embodiment, the precuring irradiation sections 41 are provided in regard to the inks of each color, respectively. That is, the precuring irradiation sections 41 are provided at the positions which are separated by a predetermined distance on the downstream side in the transport direction, respectively, with respect to the heads 31 of each color. However, the precuring irradiation section 41 which responds to the head 31 of black on the most downstream side in the transport direction is not provided. Since the head 31 of black among the four heads 31 is positioned (close to the main curing irradiation section 42) on the most downstream side in the transport direction, regarding black, even the main curing can be performed with the irradiation of the UV at once by the main curing irradiation section 42 (in other words, it is not necessary to perform the precuring). In the printer 1 according to the embodiment, the precuring irradiation section 41 which responds to the head 31 of black is not provided. Instead, the dummy irradiation section 43 that is not irradiated with the UV is provided.

The main curing irradiation section 42 is provided on the downstream side in the transport direction than each heads 31 and the precuring irradiation sections 41 (including the dummy irradiation section 43). That is, the distance between the head 31 of black on the most downstream side in the transport direction and the main curing irradiation section 42 is greater than the predetermined distance (the distance between the head 31 and the precuring irradiation section 41), in the transport direction.

The length of the precuring irradiation section 41 and the main curing irradiation section 42 in the paper width direction are almost the same as the length of the heads 31 in the paper width direction. Furthermore, in the embodiments, the precuring irradiation section 41 and the main curing irradiation section 42 include a light emitting diode (Light Emitting Diode: abbreviated to LED, hereinafter) as a light source of the UV. The amount (light quantity) of the UV with which is irradiated from each irradiation section is controlled by changing an input current to the LED by the controller 60.

Figure 3:
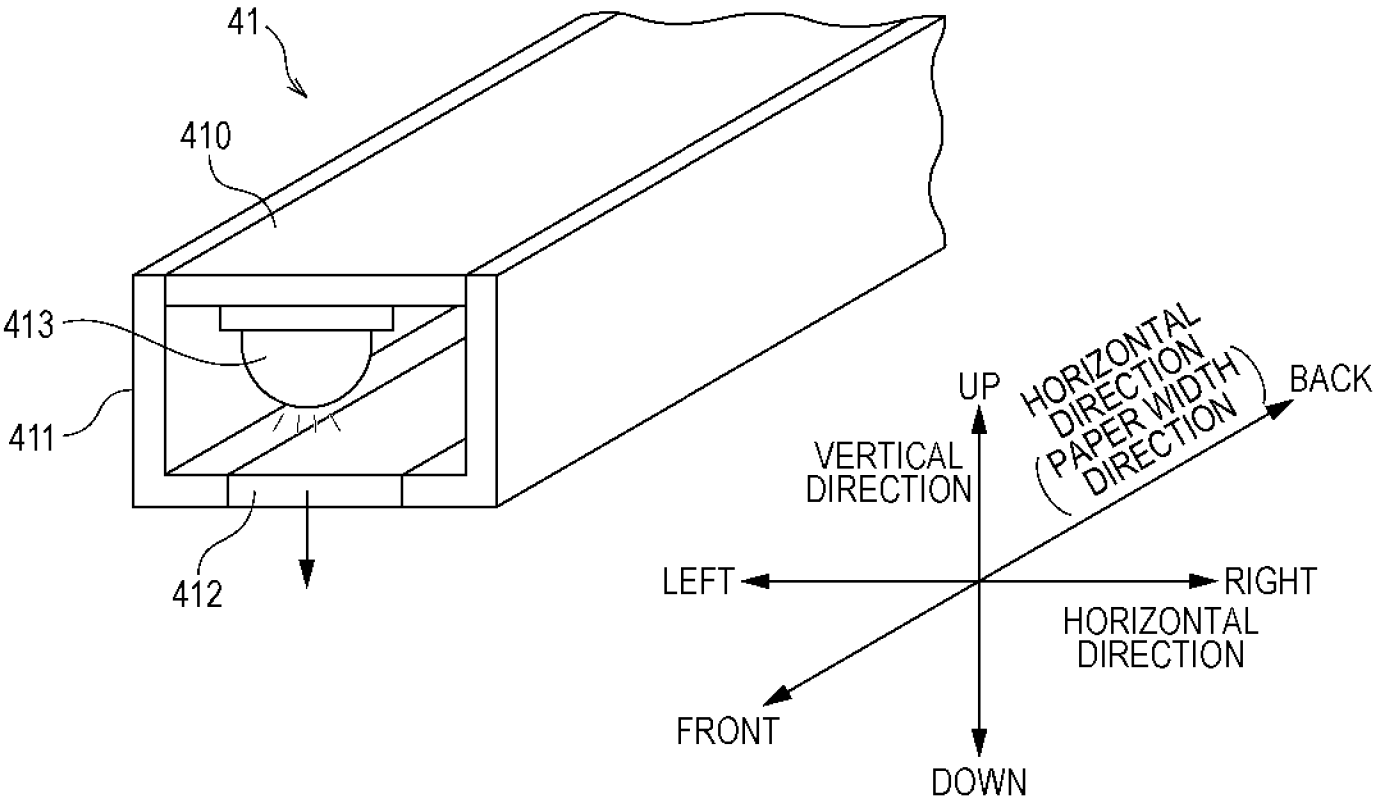
FIG. 3 is a perspective view illustrating a configuration of an irradiation section schematically.

FIG. 3 is a perspective view illustrating an example of the configuration of the irradiation section schematically. In FIG. 3, the precuring irradiation section 41 which responds to magenta (M) (that is, an irradiation direction of the UV is vertically downward) is shown, among the four precuring irradiation sections 41 which are arranged in the peripheral surface of the transport drum 26 in FIG. 2. Other precuring irradiation sections 41 and the main curing irradiation section 42 also have the same configuration.

As shown in FIG. 3, the precuring irradiation section 41 includes a substrate 401, a cover member 411, a glass plate 412, and a LED 413.

The substrate 401 is a rectangular plate type member, and is arranged so that the longitudinal direction thereof is along the paper width direction.

The cover member 411 is a member of which a cross section is the L-shape. As shown in FIG. 3, the cover members 411 are arranged at both ends in left and right direction of the substrate 401 so as to hold the substrate 401 therebetween, thereby forming side walls of the precuring irradiation section 41. Moreover, a gap is formed between the two cover members 411 in a lower portion of the precuring irradiation section 41. A surface color of the cover member 411 is black.

For example, the glass plate 412 is a transparent plate type member and is provided along the gap between the two cover members 411 (along the paper width direction).

The LED 413 is a hemispherical member, and irradiates with the UV by emitting the light when the power is supplied to an electrode which is not shown. The LED 413 is provided so as to face the glass plate 412 (in other words, so as to face the roll paper S) in a lower surface of the substrate 401. The plural LED 413 are provided along the paper width direction. Therefore, the precuring irradiation section 41 can irradiate with the UV at once in the paper width direction of the roll paper S.

Regarding Mist Recovery Unit

The mist recovery unit 70 includes the mist recovery section 71, as described above.

Figure 4:
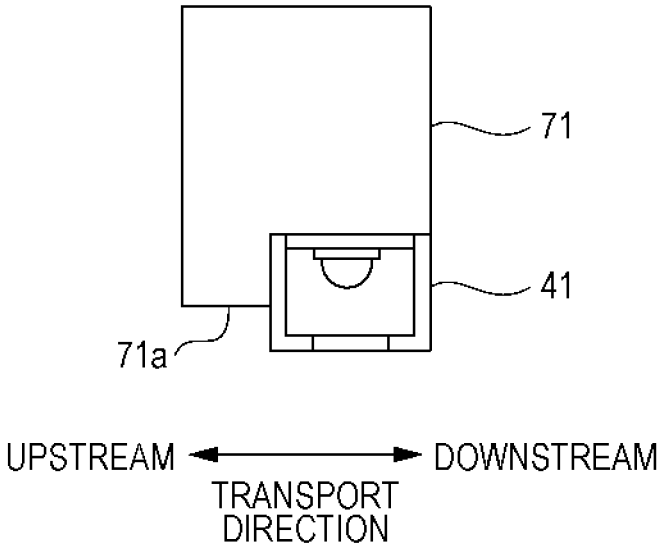
FIG. 4 is an enlarged view illustrating a mist recovery section and a precuring irradiation section.

FIG. 4 is an enlarged view illustrating the mist recovery section 71 and the precuring irradiation section 41.

The mist recovery section 71 includes an absorption port 71*a* of the mist.

In the mist recovery section 71, the absorption port 71*a* is provided so as to face the roll paper S on the upstream side (position close to the head 31) in the transport direction.

The mist recovery section 71 absorbs the mist that is generated when the responding head 31 (head 31 which is positioned on the upstream side in the transport direction) discharges the droplets of the ink, from the absorption port 71*a* by rotating a fan (not shown) which is built in. Accordingly, it is possible to prevent the mist that is generated in the case of discharging the droplets of the ink from floating, and it is possible to prevent the inside of the printer 1 from being contaminated with the mist.

Furthermore, as described above, the mist recovery sections 71 are respectively provided on the downstream side in the transport direction, with respect to the heads 31 of each color. By arranging the mist recovery section 71 on the downstream side in the transport direction of the head 31, it is possible to efficiently move the mist to the mist recovery section 71. That is, when the roll paper S is transported in the transport direction, the air on the roll paper S also flows in the transport direction. The flow of the air is combined with the absorption operation of the mist by the mist recovery section 71, and thus, it is possible to efficiently recover the mist.

In the mist recovery section 71, the precuring irradiation section 41 is provided on the downstream area (portion) in the transport direction than the absorption port 71*a*. However, as described above, in the mist recovery section 71 which is positioned between the head 31 of black and the main curing irradiation section 42, the dummy irradiation section 43 is provided instead of the precuring irradiation section 41.

Regarding Dummy Irradiation Section

Figure 5:
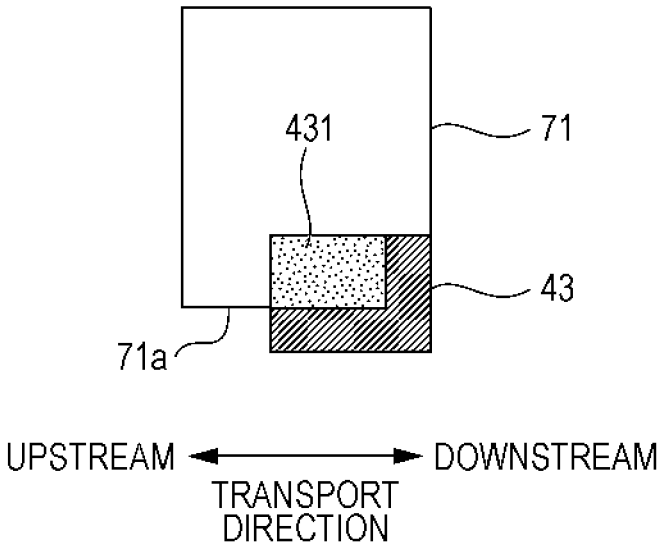
FIG. 5 is a diagram illustrating an example of a configuration of a dummy irradiation section.

FIG. 5 is a diagram illustrating an example of the configuration of the dummy irradiation section 43. In addition, FIG. 6 is a schematic diagram of the periphery of the dummy irradiation section 43 in the printer 1.

The dummy irradiation section 43 is provided so as to have the same outer shape as the precuring irradiation section 41, using a material which is resistant to the UV ink, such as plastic and sheet metal. As shown in FIG. 5, in the mist recovery section 71, the dummy irradiation section 43 is installed at the same position as the position to which the precuring irradiation section 41 is installed (see FIG. 4). Accordingly, the distance between the dummy irradiation section 43 and the roll paper S is the same as the distance between the precuring irradiation section 41 and the roll paper S. Moreover, an ink absorbent material 431 (corresponding to the liquid absorbent material) is provided in the inside of the dummy irradiation section 43.

The ink absorbent material 431 absorbs the ink (black ink, in the embodiment) which hangs down from the head 31 and the absorption port 71*a* of the mist recovery section 71.

Figure 6:
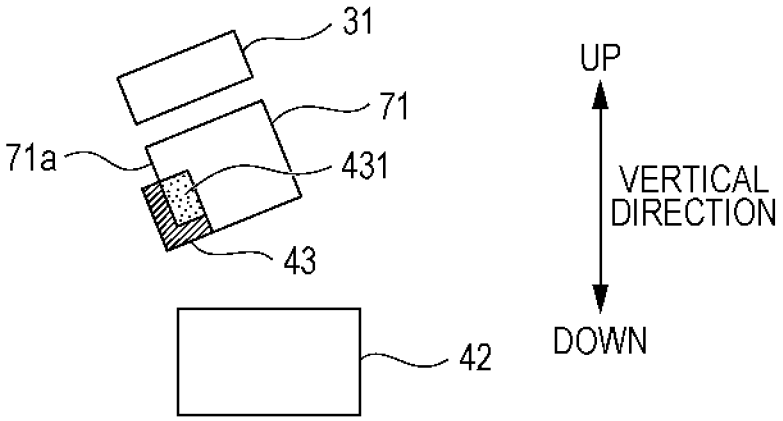
FIG. 6 is a schematic diagram of a periphery of the dummy irradiation section in the printer.

As shown in FIG. 6, in the printer 1 according to the embodiment, the head 31 of black and the mist recovery section 71 (and the dummy irradiation section 43) on the downstream side of the head 31 are provided so as to be obliquely inclined with respect to the vertical direction. Therefore, for example, there is a concern that the ink falls by hanging down from the head 31 and the mist recovery section 71 when the print is not performed. At that case, the dummy irradiation section 43 of the embodiment is provided with the ink absorbent material 431 at the position which is close to the absorption port 71*a* of the mist recovery section 71. Accordingly, it is possible to absorb the ink that falls from the head 31 and the absorption port 71*a* of the mist recovery section 71 by the ink absorbent material 431.

If the UV (for example, the light which is leaked from the main curing irradiation section 42) hits the ink absorbent material 431, the ink absorbent material 431 is cured. Therefore, in the embodiment, the ink absorbent material 431 is provided at the position where the light from the main curing irradiation section 42 does not hit, as shown in FIG. 6. Accordingly, it is possible to prevent the ink absorbent material 431 from solidifying due to the leaked light of the UV, and it is possible to prevent the absorbency from falling.

In order to prevent the leaked light from the main curing irradiation section 42 from affecting the head 31 or the like, it is preferable that the color of the outer wall (surface) of the dummy irradiation section 43 is the color (color having low reflectance) that absorbs the light. Therefore, the color of the outer wall of the dummy irradiation section 43 is black in the embodiment.

Figure 7A:
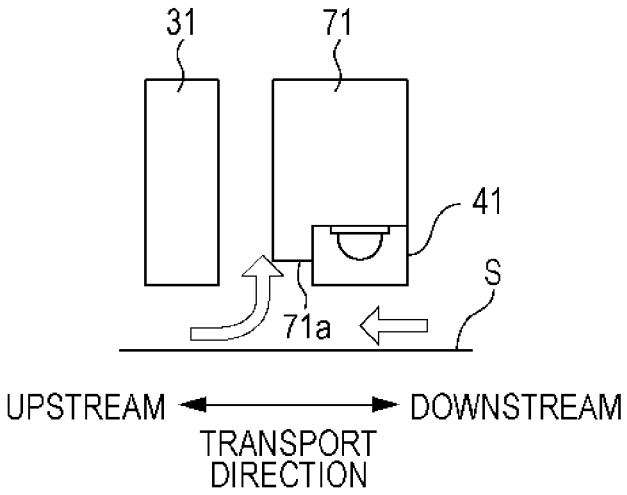
FIG. 7A to FIG. 7C are conceptual diagrams illustrating a reason for providing the dummy irradiation section.
Figure 7B:
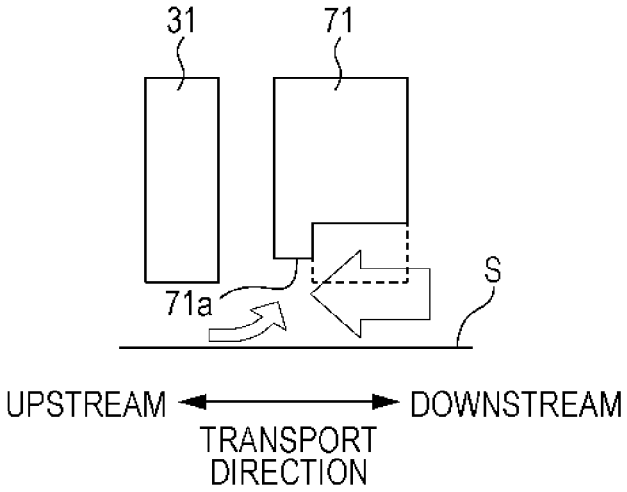
Figure 7C:
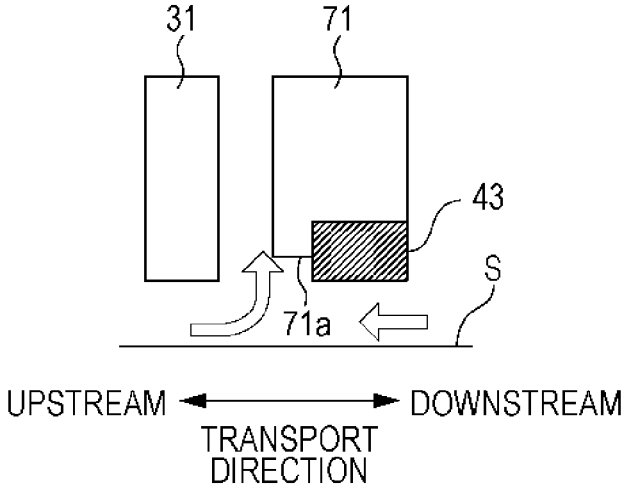

FIG. 7A to FIG. 7C are conceptual diagrams illustrating a reason for providing the dummy irradiation section 43. FIG. 7A is a diagram of a case of providing the precuring irradiation section 41 in the mist recovery section 71, FIG. 7B is a diagram of a case of not providing the precuring irradiation section 41 (and the dummy irradiation section 43) in the mist recovery section 71, and FIG. 7C is a diagram of a case of providing the dummy irradiation section 43 in FIG. 7B. In FIG. 7A to FIG. 7C, the directions of the arrows show the directions of the flow of the air, and the size of the arrows shows the amount of the air. Moreover, in FIG. 7A to FIG. 7C, it is assumed that the roll paper S is transported in the horizontal direction (the transport direction is the left and right direction in the drawing) for the simplification of the description. The members (the head 31, the mist recovery section 71 and the like) are arranged so as to face the roll paper S.

In FIG. 7A, the precuring irradiation section 41 is provided in the mist recovery section 71. Accordingly, the air which flows into the mist recovery section 71 from the downstream side in the transport direction, is blocked by the precuring irradiation section 41. Therefore, since the air which flows into the mist recovery section 71 from the upstream side in the transport direction increases, it is possible to efficiently absorb the air (the mist that is generated when the head 31 discharges the ink) from the upstream side in the transport direction.

In FIG. 7B, the precuring irradiation section 41 is not provided in the mist recovery section 71. At this case, the air which flows into the mist recovery section 71 from the downstream side in the transport direction increases, and the amount of the air which flows into the mist recovery section 71 from the upstream side in the transport direction decreases, compared with the case of FIG. 7A. That is, in FIG. 7B, it is difficult for the mist recovery section 71 to absorb the mist than the case of FIG. 7A, and the absorption efficiency of the mist is reduced. Furthermore, since the precuring irradiation section 41 is not provided, the leaked light of the UV which is irradiated with from the irradiation section (the main curing irradiation section 42) on the downstream side in the transport direction tends to hit the head 31, and there is a concern that the nozzle clogging occurs due to the solidification of the UV ink in the nozzle of the head 31.

In FIG. 7C, the dummy irradiation section 43 is provided instead of the precuring irradiation section 41. The outer shape of the dummy irradiation section 43 is the same as the outer shape of the precuring irradiation section 41, and the air which flows into the mist recovery section 71 can be the same as the case of FIG. 7A. That is, it is possible to reduce the amount of the air which flows into the mist recovery section 71 from the downstream side in the transport direction than the case of FIG. 7B, and it is possible to efficiently recover the mist from the upstream side in the transport direction. In addition, by making the color of the surface of the dummy irradiation section 43 black, it is possible to absorb the leaked light from the main curing irradiation section 42, and it is possible to prevent the leaked light from being reflected. Therefore, it is possible to suppress the nozzle clogging of the head 31 that occurs when the leaked light hits the head 31.

As described above, the printer 1 according to the embodiment includes the combination of the head 31 that discharges the droplets of the UV ink which is cured by receiving the irradiation of the UV onto the roll paper S, the mist recovery section 71 that recovers the mist of the UV ink which is discharged from the head 31 and the precuring irradiation section 41 that irradiates the UV ink which lands on the roll paper S with the UV, with respect to the inks of each color. However, since it is not necessary to perform the precuring in the portion (portion which responds to the head 31 of black in the embodiment) of the most downstream side in the transport direction, the dummy irradiation section 43 is provided instead of the precuring irradiation section 41. In addition, the main curing irradiation section 42 is provided on the downstream side in the transport direction.

Therefore, by providing the dummy irradiation section 43, it is possible to decrease the air which is absorbed from the downstream side in the transport direction than the mist recovery section 71, in the air which is absorbed into the mist recovery section 71, and it is possible to increase the air which is absorbed from the upstream side (the head 31 side) in the transport direction. Accordingly, it is possible to improve the recovery efficiency of the mist, compared with the case where the dummy irradiation section 43 is not provided.

Other Embodiments

The printer is described as an embodiment, but the embodiments described above are intended for facilitating the understanding of the invention, and are not intended for limiting the invention. The invention includes various modifications and alterations without departing from the gist thereof. The invention also includes the equivalents thereof. In particular, the invention includes even the embodiments described below.

Regarding Printer

In the embodiments described above, the printer is described as an example of the liquid discharge apparatus, but it is not limited thereto. For example, the technology which is applied to the embodiment may be applied to various liquid discharge apparatus to which the ink jet technology is applied, such as a color filter manufacturing device, a dyeing device, a fine processing device, a semiconductor manufacturing device, a surface processing device, a three-dimensional molding machine, a liquid vaporizing device, an organic EL manufacturing device (particularly, a high polymer EL manufacturing device), a display manufacturing device, a film formation device, and a DNA chip manufacturing device, in the same manner.

In the embodiments described above, the computer 110 is configured as an external device, but the computer 110 may be provided as a component of the printer 1.

In the printer 1 according to the embodiment described above, the plural heads are arranged so as to face the peripheral surface of the cylindrical transport drum 26, the image is formed by discharging the ink to the medium from each head, while transporting the media (the roll paper S) along the peripheral surface of the transport drum 26, but it is not limited thereto. For example, a printer (so-called line printer) where the print is performed on the medium by intermittently discharging the ink from the head while transporting the medium with a transport belt in the transport direction, when the head which is longer than the paper width is fixed on the transport path along the horizontal direction, may be used.

Regarding Discharge Method

In the embodiments described above, the ink is discharged, using the piezoelectric element (piezo element). However, a method for discharging the liquid is not limited thereto. For example, a method for generating bubbles in the nozzle due to heat, and other methods may be used.

Regarding Medium

In the embodiments described above, the roll paper S is described as an example of the medium, but it is not limited thereto. For example, cut paper, film, and cloth may be used.

Regarding Head

In the printer 1 according to the embodiment described above, the head unit 30 includes the four heads 31, but it is not limited thereto. The number of the head may be three or less, or five or more. In addition, the configuration (the arrangement of the nozzle or the like) of each head is not limited to the embodiments described above.

Regarding Ink

In the embodiments described above, the ink is used as a liquid in the case of using the printer as an embodiment, but the liquid to be discharged from the nozzle is not limited to thereto. For example, the liquid (including water) including a metal material, an organic material (particularly, a high polymer material), a magnetic material, a conductive material, a wiring material, a film formation material, an electronic ink, a working fluid, and a gene solution, may be discharged from the nozzle.

In the embodiments described above, the ink (UV ink) which is cured by receiving the irradiation of the ultraviolet ray (UV), is discharged from the nozzle. However, the liquid to be discharged from the nozzle is not limited to the ink which is cured by the UV light. For example, the ink which is cured by visible light may be used. In this case, it may be irradiated with the visible light (light) of wavelength which the ink is cured by, from each irradiation section.

Furthermore, in the embodiments described above, the inks of cyan, magenta, yellow and black are used as an UV ink, but the inks (for example, orange ink and red ink) of other color may be used.

Regarding Irradiation Section

In the embodiments described above, the LED is used as a light source of the precuring irradiation section 41 and the main curing irradiation section 42, but it is not limited thereto. For example, a lamp (metal halide lamp, mercury lamp or the like) may be used.

Moreover, in the embodiments described above, the precuring irradiation section 41 and the dummy irradiation section 43 are provided in the mist recovery section 71, but are not limited thereto, and may be provided on the downstream side in the transport direction than the absorption port 71*a* of the mist recovery section 71. For example, the mist recovery section 71 and the precuring irradiation section 41 (including the dummy irradiation section 43) may be separately configured.

The shape of the dummy irradiation section 43 may be different from the shape of the precuring irradiation section 41.

Figure 8:
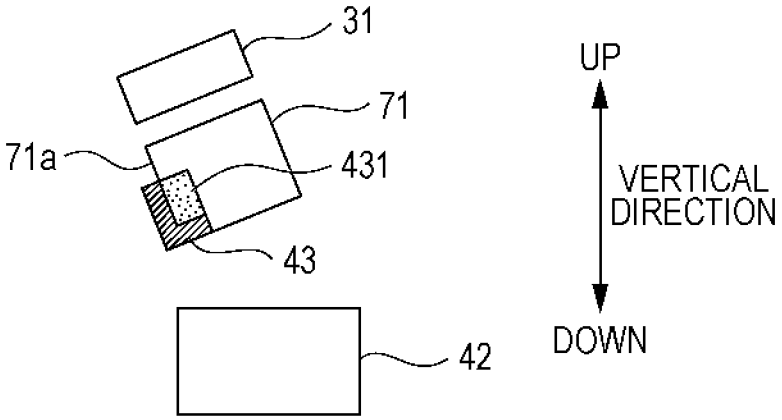
FIG. 8 is a diagram illustrating a modification example of the dummy irradiation section.

FIG. 8 is a diagram illustrating a modification example of the dummy irradiation section 43. The end of the upstream side in the transport direction may be an inclined surface, as shown in FIG. 8. In this case, it is possible to obtain the same effect as the embodiments described above.

The entire disclosure of Japanese Patent Application No. 2013-035513, filed Feb. 26, 2013 is expressly incorporated by reference herein.

What is claimed is:

1. A liquid discharge apparatus comprising:

a transport body that transports a recording medium in a transport direction;

a first head that discharges a first droplet of a first photocurable liquid which is cured by receiving irradiation of light onto the recording medium which is supported by the transport body;

a second head that is arranged on a downstream side in the transport direction from the first head and discharges a second droplet of a second photocurable liquid onto the recording medium which is supported by the transport body;

a first irradiation section that is arranged between the first head and the second head and irradiates the first photocurable liquid which lands on the recording medium with the light;

a second irradiation section that is larger than the first irradiation section in terms of an integrating light amount per unit area of the recording medium and is arranged on the downstream side in the transport direction from the second head so that a distance between the second head and the second irradiation section is greater than that between the first head and the first irradiation section;

a first mist recovery section that is arranged between the first head and the first irradiation section and recovers a mist of the first photocurable liquid which is discharged from the first head;

a second mist recovery section that is arranged between the second head and the second irradiation section and recovers the mist of the second photocurable liquid which is discharged from the second head; and an air flow adjustment member that is arranged between the second mist recovery section and the second irradiation section, adjusts an amount of air which flows into the second mist recovery section, and makes the air which flows into the second mist recovery section from the downstream side in the transport direction smaller than a case where the air flow adjustment is not arranged between the second mist recovery section and the second irradiation section.

2. The liquid discharge apparatus according to claim 1, wherein a distance between the second head and the air flow adjustment member in the transport direction is the same as the distance between the first head and the first irradiation section in the transport direction, and the air flow adjustment member has the same shape as the first irradiation section.

3. The liquid discharge apparatus according to claim 1, wherein the first mist recovery section and the second mist recovery section have the same shapes, the first irradiation section is attached to a portion of the first mist recovery section on the downstream side in the transport direction from an absorption port which is included in the first mist recovery section, and the air flow adjustment member is attached to a portion of the second mist recovery section on the downstream side in the transport direction from an absorption port which is included in the second mist recovery section, and the attached position is the same as the position where the first irradiation section is attached to the first mist recovery section.

4. The liquid discharge apparatus according to claim 1, wherein the transport body is a cylindrical transport drum which transports the recording medium in a peripheral surface.

5. The liquid discharge apparatus according to claim 4, wherein the second head and the second mist recovery section are provided to be inclined with respect to a vertical direction so as to face the peripheral surface of the transport drum, and the air flow adjustment member includes a liquid absorbent material to absorb the photocurable liquid.

6. The liquid discharge apparatus according to claim 1, wherein a surface color of the air flow adjustment member is black.

* * * * *